US009631290B2

(12) United States Patent
Hatchett et al.

(10) Patent No.: US 9,631,290 B2
(45) Date of Patent: Apr. 25, 2017

(54) ROOM TEMPERATURE ELECTRODEPOSITION OF ACTINIDES FROM IONIC SOLUTIONS

(71) Applicant: The Board of Regents of the Nevada System of Higher Education on Behalf of the University of Nevada, Las Vegas, Las Vegas, NV (US)

(72) Inventors: David W. Hatchett, Las Vegas, NV (US); Kenneth R. Czerwinski, Seattle, WA (US); Janelle Droessler, Las Vegas, NV (US); John Kinyanjui, Laural, MD (US)

(73) Assignee: THE BOARD OF REGENTS OF THE NEVADA SYSTEM OF HIGHER EDUCATION ON BEHALF OF THE UNIVERSITY OF NEVADA, LAS VEGAS, Las Vegas, NV (US)

( * ) Notice: Subject to any disclaimer, the term of this patent is extended or adjusted under 35 U.S.C. 154(b) by 0 days.

(21) Appl. No.: 13/764,282

(22) Filed: Feb. 11, 2013

(65) Prior Publication Data

US 2013/0233716 A1 Sep. 12, 2013

Related U.S. Application Data

(63) Continuation-in-part of application No. 13/268,138, filed on Oct. 7, 2011.

(51) Int. Cl.

| | |
|---|---|
| ***C25C 3/34*** | (2006.01) |
| ***C25D 3/66*** | (2006.01) |
| ***C25D 3/54*** | (2006.01) |

(52) U.S. Cl.

CPC ..... *C25C 3/34* (2013.01); *C25D 3/54* (2013.01); *C25D 3/665* (2013.01)

(58) Field of Classification Search

CPC ..... C25C 3/34; C25C 3/665
USPC ..... 205/47, 48
See application file for complete search history.

(56) References Cited

U.S. PATENT DOCUMENTS

| | | | | |
|---|---|---|---|---|
| 2,446,331 | A | 8/1948 | Hurley | |
| 2,446,349 | A | 8/1948 | Weir et al. | |
| 2,446,350 | A | 8/1948 | Weir | |
| 2,924,506 | A | 2/1960 | Anderson | |
| 3,030,176 | A | 4/1962 | Lyon | |
| 4,552,588 | A | 11/1985 | Elliot | |
| 4,839,149 | A * | 6/1989 | Madic et al. | 423/251 |
| 5,205,999 | A | 4/1993 | Willis et al. | |
| 5,582,706 | A | 12/1996 | Grantham et al. | |
| 6,233,298 | B1 | 5/2001 | Bowman | |
| 6,379,634 | B1 * | 4/2002 | Fields et al. | 423/4 |
| 6,911,135 | B1 * | 6/2005 | Thied et al. | 205/44 |
| 7,011,736 | B1 * | 3/2006 | Miller et al. | 205/47 |
| 7,097,747 | B1 * | 8/2006 | Herceg et al. | 204/201 |
| 7,267,754 | B1 | 9/2007 | Willit | |
| 2006/0169590 | A1 * | 8/2006 | Hebditch et al. | 205/46 |
| 2007/0129568 | A1 | 6/2007 | Flanagan et al. | |
| 2007/0272557 | A1 * | 11/2007 | Matthews | 205/46 |
| 2008/0128284 | A1 | 6/2008 | Penner et al. | |
| 2008/0214814 | A1 * | 9/2008 | Li et al. | 544/336 |
| 2011/0151607 | A1 | 6/2011 | Landis et al. | |
| 2013/0233716 | A1 | 9/2013 | Hatchett et al. | |

FOREIGN PATENT DOCUMENTS

| | | | |
|---|---|---|---|
| WO | 2001/013379 | A1 | 2/2001 |
| WO | 2007/147222 | A2 | 12/2007 |
| WO | 2009019147 | | 2/2009 |

OTHER PUBLICATIONS

Arthur Rose et al, The Condensed Chemical Dictionary, seventh edition, Reinhold Book Corporation, New York, 1968, pp. 701.*
EPA, Ozone (O3) Standards—Table of Historical Ozone NAAQs.*
Asanuma et al., "Electrochemical Properties of Uranyl Ion in Ionic Liquids as Media for Pyrochemical Reprocessing" J. Nucl. Sci. Technol. 44(3), pp. 368-372 (2007).*
Rao et al., "Dissolution of Uranium Oxides and Electrochemical Behavior of U(VI) in Task Specific Ionic Liquid" Radiochim Acta 96, pp. 403-409 (2008).*
"Room Temperature" Hawley's Condensed Chemical Dictionary, p. 1095 (2007).*
Bhatt et al., "Cyclic Voltammetry of Th(IV) in the Room-Temperature Ionic Liquid [Me3NnBu] [N(SO2CF3)2]" Inorg. Chem. 45, pp. 1677-1682 (2006).*
Table of Standard Electrode Reduction and Oxidation Potential Values accessed from https://rsteyn.files.wordpress.com/2010/07/reduction-and-oxidation-potential.pdf on Aug. 11, 2016.*
Srncik, M.; Kogelnig, D.; Stojanovic, A.; Koerner, W.; Krachler, R.; Wallner, G.; Journal of Applied Radiation and Isotopes, "Uranium Extraction from Aqueous Solutions by Ionic Liquids," (2009), 67(12), 2146-2149.
Iizuka, M.; Koyama, T.; Kondo, N.; Fujita, R.; Tanaka, H. Journal of Nuclear Materials, "Actinides Recovery from Molten Salt/Liquid Metal System by Electrochemical Methods," (1997), 247, 183-190.

(Continued)

*Primary Examiner* — Bryan D. Ripa
(74) *Attorney, Agent, or Firm* — Michael Best & Friedrich LLP

(57) ABSTRACT

Uranic and transuranic metals and metal oxides are first dissolved in ozone compositions. The resulting solution in ozone can be further dissolved in ionic liquids to form a second solution. The metals in the second solution are then electrochemically deposited from the second solutions as room temperature ionic liquid (RTIL), tri-methyl-n-butyl ammonium n-bis(trifluoromethansulfonylimide) [$Me_3N^nBu$][TFSI] providing an alternative non-aqueous system for the extraction and reclamation of actinides from reprocessed fuel materials. Deposition of U metal is achieved using TFSI complexes of U(III) and U(IV) containing the anion common to the RTIL. TFSI complexes of uranium were produced to ensure solubility of the species in the ionic liquid. The methods provide a first measure of the thermodynamic properties of U metal deposition using Uranium complexes with different oxidation states from RTIL solution at room temperature.

9 Claims, 2 Drawing Sheets

(56) References Cited

OTHER PUBLICATIONS

Kim, K. R.; Bae, J. D.; Park, B. G.;Anh, D. H.; Paek, S.; Kwon, S. W.; Shim, J. B.; Kim, S. H.; Lee, H.S.; Kim, E.H.; Hwang, I. S. J Radioanal Nucl Chem, "Electro-fluid Analysis of a Molten-salt Electrorefiner with Rotating Cruciform Anode Baskets," (2010), 280, 801-406.

Koyama, T.; Iizuka, M; Shoji, Y.; Fujita, R.; Tanaka, H.; Kobayashi, T.; Tokiwai, M. Journal of Nuclear Science and Technology, "An Experimental Study of Molten Salt Electrorefining of Uranium Using Solid Iron Cathode and Liquid Cadmium Cathode for Development of Pyrometallurgical Reprocessing," (Apr. 1997), vol. 34 No. 4, 384-393.

International Search Report and Written Opinion in International Application No. PCT/US2014/015749, mailed May 12, 2014, 10 pages.

Beller et al., Actinide Foil Production for MPACT Research, Project No. 11-3138, U.S. Department of Energy, Oct. 30, 2012, 24 pages.

International Search Report and Written Opinion for Application No. PCT/US15/53323 dated Feb. 1, 2016 (9 pages).

Pemberton et al., "Electrochemistry of soluble UO2 2+ from the direct dissolution of UO2CO3 in acidic ionic liquid containing water", Electrochimica Acta, 2013, vol. 93, pp. 264-271.

Bhatt et al., "Structural Characterization of a Lanthanum Bistriflimide Compex, La(N(SO2CF3)2)3(H2O)3, and an Investigation of La, Sm, and Eu Electrochemistry in a Room-Temperature Ionic Liquid, [Me3NnBu][N(SO2CF3)2]", Inorg. Chem. 44, pp. 4934-4940, (2005).

Legeai et al., "Room-Temperature Ionic Liquid for Lanthanum Electrodeposition", Electrochem. Comm. 10, pp. 1661-1664, (2008).

Chen et al., "Electrodeposition of Cesium at Mercury Electrodes in the Tri-1-Butylmethylammonium Bis((trifluoromethyl)sulfonyl)imide Room-Temperature Ionic Liquid", Electrochim. Acta 49, pp. 5125-5138, (2004).

Beller et al., Actinide Foil Production for MPACT Research, Project No. 11-3138, U.S. Department of Energy (2012).

Supplementary European Search Report mailed in European Patent Application No. 14749320.9 (Aug. 9, 2016).

* cited by examiner

Figure 1. Cyclic Voltammetric response of an Au electrodein RTIL (dashed line) and RTIL solution containing $U(TFSI)_3$ (solid line).
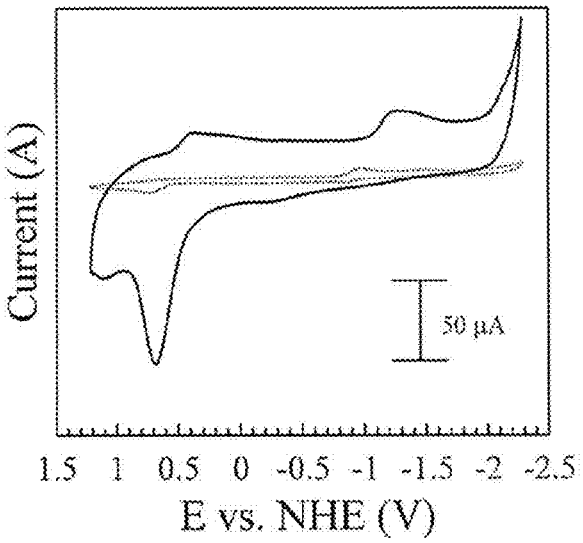
Figure 2. Top: SEM image of Au surface prior to deposition. Bottom: SEM image of U deposited on Au from RTIL solution containing $U(TFSI)_3$.
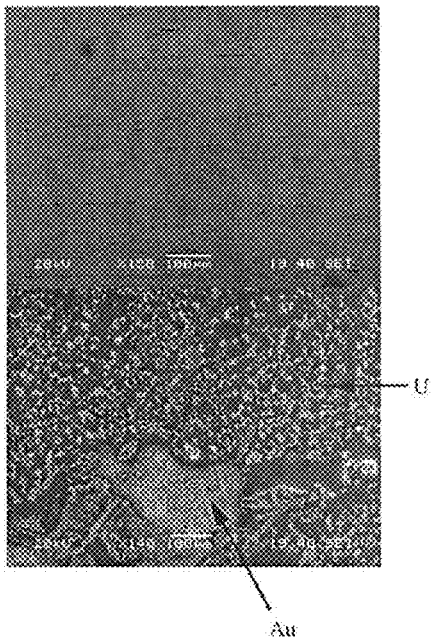

Figure 3. Energy dispersive spectra for U deposits on an Au electrode from RTIL solution containing $U(TFSI)_3$.
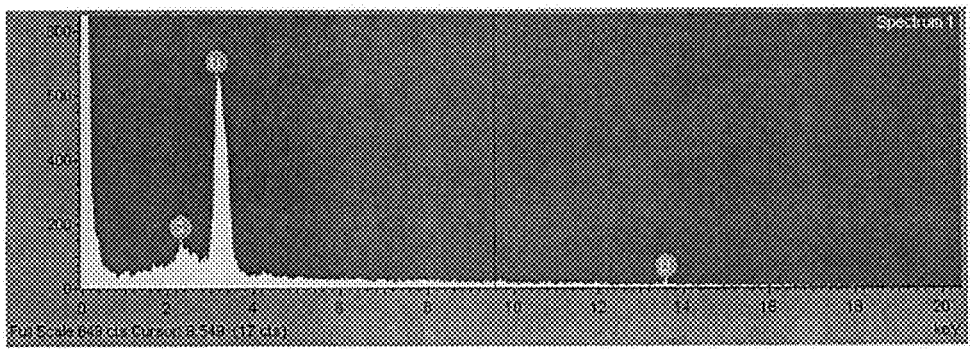
Figure 4. Powder XRD fit for uranium deposits from $U(TFSI)_3$ on a gold electrode.
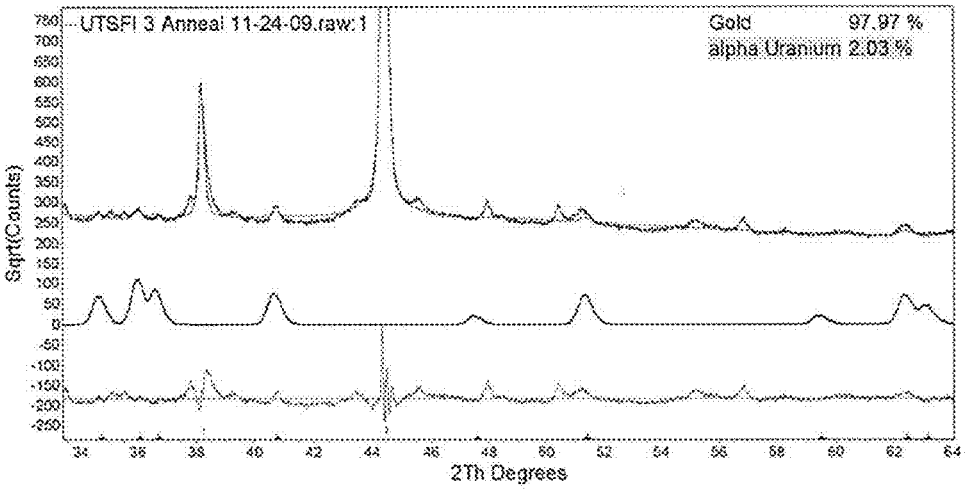

ROOM TEMPERATURE ELECTRODEPOSITION OF ACTINIDES FROM IONIC SOLUTIONS

RELATED APPLICATION DATA

This application is a Continuation-in-Part application of and claims priority to U.S. application Ser. No. 13/268,138, filed 7 Oct. 2011, which is incorporated herein by reference.

GOVERNMENT FUNDING

This invention was made with government support under DE-AC07-05ID14517 and DE-FC07-06ID14781 awarded by the Department of Energy. The government has certain rights in the invention.

BACKGROUND OF THE INVENTION

1. Field of the Invention

The present invention relates to the field of deposition of metals, especially electrodeposition of actinides, and especially the room temperature electrodeposition of lanthanides and actinides from ionic liquids.

2. Background of the Art

Reclaiming unspent nuclear materials, while separating and sequestering fission products is extremely important in the management of the growing stockpile of nuclear waste. More importantly, reclamation of the actinide metals is important for future safety due to the possible proliferation of weapons. (Morss, L. R.; Edelstein, N. M.; Fuger, J.; Katz, J. J.; Kirby, H. W.; Wolf, S. F.; Haire, R. G.; Burns, C. J.; Eisen, M. S. *The Chemistry of the Actinide and Transactinide Elements*; third.; Springer Netherlands, 2006) Finally, reclamation of unused uranium from nuclear fuel is of general importance for reuse in energy processes and for the production of target material to generate useful radio pharmaceutical species for biological applications. (Hofman, G. L.; Wiencek, T. C.; Wood, E. L.; Snelgrove, J. L.; Suripto, A.; Nasution, H.; Amin, D. L.; Gogo, A. In 19*th International Meeting on Reduced Enrichment for Research and Test Reactors;* 1996.)

Typical electrochemical processes to recover uranium from spent nuclear fuel result in the accumulation of minor actinides (americium (Am) and curium (Cu)) and transuranic elements (plutonium (Pu) and neptunium (Np)). These accumulated elements usually occur as metal chlorides in the molten electrolytic salt. They must periodically be removed from the electrolyte for the fuel reprocessing to continue.

The simplest method to recover the target elements is via chemical or electrochemical reduction. Electrochemical reduction has two advantages over chemical reduction. The first advantage is that the site of reduction is localized to the cathode surface forming a cathode deposit affording easy removal from the process equipment. The second advantage is that the use of electrons as the reducing agent does not add to the waste volume. Deposition of the transuranic elements and minor actinides on a solid cathode is well-known. Accompanying anode reactions include the oxidation of chloride ions to chlorine gas, oxidation of a sacrificial alloy, and oxidation of metallic uranium or reduced light water reactor (LWR) feed material.

U.S. Pat. No. 7,267,754 (Willit) discloses an improved process and device for the recovery of the minor actinides and the transuranic elements (TRU's) from a molten salt electrolyte. The process involves placing the device, an electrically non-conducting barrier between an anode salt and a cathode salt. The porous barrier allows uranium to diffuse between the anode and cathode, yet slows the diffusion of uranium ions so as to cause depletion of uranium ions in the catholyte. This allows for the eventual preferential deposition of transuranics present in spent nuclear fuel such as Np, Pu, Am, Cm.

U.S. Pat. No. 6,233,298 (Bowman) describes a subcritical reactor-like apparatus for treating nuclear wastes, the apparatus comprising a vessel having a shell and an internal volume, the internal volume housing graphite. The apparatus has means for introducing a fluid medium comprising molten salts and plutonium and minor actinide waste and/or fission products. The apparatus also has means for introducing neutrons into the internal volume wherein absorption of the neutrons after thermalization forms a processed fluid medium through fission chain events averaging approximately 10 fission events to approximately 100 fission events. The apparatus has additional means for removing the processed fluid medium from the internal volume. The processed fluid medium typically has no usefulness for production of nuclear weapons.

Uranium Separation Process, U.S. Pat. No. 3,030,176, April 1962. This work outlines the dissolution of Uranium and the separation of species from fission products. The work outlines the use of molten salts in the separation. The advantage of our method is that RTIL solutions are ionic providing the same properties without the need for elevated temperatures (500-750 C) that the molten salts require which reduces the production of unwanted gases in the recovery process.

Electroseparation of actinide and rare earth metals. U.S. Pat. No. 5,582,706, Dec. 10, 1996. The work outlines a pyrochemical process used to recover 99% of the transmutable fission materials. The process uses the electrochemical separation of the waste component. Our method does not require multiple paths or pyrochemical methods to achieve dissolution or separation of the fission products.

Actinide Dissolution. U.S. Pat. No. 5,205,999, Apr. 27, 1993. The work documents the dissolution of the actinide and lanthanide species in aqueous solution between pH 5.5 to 10 utilizing complexing agents. Our methods are conducted under similar conditions in room temperature ionic liquid. The same solution is used for the electrochemical separation and deposition of actinide species. Our method does not require complexing agents, it is performed in non-aqueous solution, and the direct dissolution is achieved in the same solvent system used for electrodepositon.

Magnesium Reduction of Uranium Fluoride in Molten Salts. U.S. Pat. No. 4,552,588, Nov. 12, 1985. The work documents the use of Mg molten salts in the reduction of $UF_4$ to U metal. The temperatures required for the process are on the order of 1000 degrees. There are inherent dangers associated with molten salts at high temperatures that are eliminated when RTIL solutions are used.

To date the PUREX process is the most widely utilized methods for the reclamation of actinides (Uranium and Plutonium) from partially spent nuclear materials. PUREX is an acronym standing for Plutonium—URanium EXtraction—the standard aqueous nuclear reprocessing method for the recovery of uranium and plutonium from used nuclear fuel. It is based on liquid-liquid extraction ion-exchange. The PUREX process was invented by Herbert H. Anderson and Lamed B. Aspreyas part of the Manhattan Project. Their U.S. Pat. No. 2,924,506, "Solvent Extraction Process for Plutonium" filed in 1947, mentions tributyl phosphate as the major reactant which accomplishes the bulk of the chemical extraction.

The method utilizes a complexing agent, tri-n-butylphosphate (TBP) and organic solvent such as kerosene or n-dodecane in the extraction and reclamation process. Modifications to the process have been primarily focused on developing new complexing agents or using different solvents for extraction. More recently the RTIL solutions have been examined as an alternative to more volatile organic diluents using tricaprylmethylammonium thiosalicylate as the complexing agent in the extraction of U into RTIL solution. Srncik, M.; Kogelnig, D.; Stojanovic, A.; Koerner, W.; Krachler, R.; Wanner, G. *Uranium extraction from aqueous solutions by ionic liquids*, Applied Radiation and Isotopes (2009), 67(12), 2146-2149. The added benefit of RTIL solutions is that it can be used in the direct electrochemical deposition of lanthanide or actinides species due the large potential window afforded by the non-aqueous system.

At present the accepted electrochemical method utilized to obtain uranium metal is based on molten salt eutectic system. (Iizuka, M.; Koyama, T.; Kondo, N.; Fujita, R.; Tanaka, H. *Journal of Nuclear Materials* 1997, 247, 183-190. Kim, K. R.; Bae, J. D.; Park, B. G.; Ahn, D. H.; Paek, S.; Kwon, S. W.; Shim, J. B.; Kim, S. H.; Lee, H. S.; Kim, E. H.; Hwang, I. S. *J Radioanal Nucl Chem* 2009, 280, 401-404. Koyama, T.; Iizuka, M.; Shoji, Y.; Fujita, R.; Tanaka, H.; Kobayashi, T.; Tokiwai, M. *Journal of Nuclear Science and Technology* 1997, 34, 384-393.

Internationally there are two well developed molten salts processes for the reprocessing/waste conditioning of irradiated nuclear fuel. A process developed by the Dimitrovgrad SSC-RIAR process uses high temperature (1000K) eutectic molten salt mixtures as solvents for the fuel and also as electrolyte systems. In this Russian system the solvent is typically an eutectic mixture of NaCl/KCl or CsCl/KCl. The process uses chemical oxidants (chlorine and oxygen gases) to react with powdered $UO_2$ fuel, or mixtures of $UO_2$ and $PuO_2$, to form higher oxidation state compounds such as $UO_2Cl_2$ which are soluble in the molten salt. At the cathode the uranium and, if applicable, plutonium compounds are reduced to $UO_2$ or $UO_2$—$PuO_2$, which form crystalline deposits. However, after a period of use the molten salt becomes loaded with fission products which not only begin to affect the quality of the product, but also result in too much heat generation within the salt. These fission products are commonly, but not exclusively, highly active lanthanide or actinide elements which may need to be isolated in a suitable form for immobilisation as a waste.

In the process developed by Argonne National Laboratory (ANL) in the USA, molten LiCl/KCl eutectic mixtures containing some UCl.sub.3 are generally used, rather than systems containing sodium or caesium salts, and a high temperature (around 773K) is again employed. However, single salts, such as LiCl, are suitable if higher temperatures are required, for example in the electrochemical reduction of fuel oxides. The process treats the spent nuclear fuel by flowing a current to oxidize a uranium anode and form uranium ions in the molten salt electrolyte. At the cathode the uranium is reduced and deposited as uranium metal. The ANL process is, unfortunately, a batch process, since the uranium is collected in a receptacle at the bottom of the apparatus, requiring that the process is interrupted in order that the receptacle may be withdrawn and the product recovered. In addition, the operation of the process is mechanically intense, involving the use of rotating anodes which are designed to scrape the product off the cathodes; difficulties are encountered on occasions due to the seizure of this mechanism.

While these methods have been utilized to produce U metal, it is not without flaws. From an engineering standpoint, the high temperatures needed for a molten salt system create safety and cost issues for the vessel material fabrication. (Avallone, E.; Baumeister, T.; Sadegh, A. *Marks' Standard handbook for mechanical Engineers;* 11th ed.; Mc-Graw Hill Professional, 2006. *Creep & Fracture in High Temperature Components: Design & Life Assessment Issues*; Shibli, I.; Holdsworth, S.; Merckling, G., Eds.; DESTech Publications, Inc., 2005). In addition, gas evolution is problematic due to environmental concerns and the safety of the workers. The second method is based on the synthesis of $UF_4$ using HF gas. (Pushparaja; Poplit, K.; Kher, R.; Iyer, M. *Radiation protection dosimetry* 1992, 42, 301-305.) The process is expensive and dangerous process due to the health hazards and corrosive nature of hydrofluoric acid. In addition, reduction of the $UF_4$ to metal using plasma and hydrogen is complicated by disproportionation and production of $UF_3$ limiting the overall metal conversion.

All references cited herein are incorporated in their entirety by reference.

SUMMARY OF THE INVENTION

The present invention relates to a method for the electrochemical deposition of an actinide or lanthanide with at least steps of: providing an actinide ion in a room temperature ionic liquid to form an actinide rich liquid composition; providing an electrode and a cathode within the actinide rich liquid composition; and at temperatures below 30° C., applying a potential such that current passes between the electrode and cathode to deposit actinide metal on the cathode.

BRIEF DESCRIPTION OF THE FIGURES

FIG. 1 shows a graphic representation of the Cyclic Voltammetric response of an Au electrodein RTIL (dashed line) and RTIL solution containing $U(TFSI)_3$ (solid line).

FIG. 2 shows a photomicrograph (scanning electron micrographs) of Top: SEM image of Au surface prior to deposition. Bottom: SEM image of U deposited on Au from RTIL solution containing $U(TFSI)_3$.

FIG. 3 shows a graph of an Energy dispersive spectra for U deposits on an Au electrode from RTIL solution containing $U(TFSI)_3$.

FIG. 4 shows a graphic representation of Powder XRD fit for uranium deposits from $U(TFSI)_3$ on a gold electrode.

DETAILED DESCRIPTION OF THE INVENTION

The present disclosure provides encompasses methods of introducing varying f-species into a Room Temperature Ionic Liquid (RTIL) using extraction or direct dissolution. Introduction of an actinide or lanthanide without organic diluent or a secondary complexing agent into the RTIL solvent is novel and has not yet been demonstrated. The direct dissolution of uranium complexes and the potential dependent deposition of these species in metal form has not been present in previous literature. While direct addition of certain lanthanide and actinide species has been documented; very little information is available regarding the potential mediated lectrodeposition of the corresponding f-metals from the RTIL solvent at room temperature. For example, the deposition and subsequent identification of metallic uranium at room temperatures has not been published in the literature to date.

Room temperature ionic liquids (RTILs) are a potential solution to molten salts because they have similar electrochemical properties without the need for elevated temperature. The large potential window of RTIL solutions is useful for electrochemical reduction of oxidized actinides and lanthanides, they have negligible vapor pressures, and are stable chemically even at elevated temperatures. (Reddy, R. G. *JPED* 2006, 27, 210-211. Cocalia, V. A.; Gutowski, K. E.; Rogers, R. D. *Coordination Chemistry Reviews* 2006, 250, 755-764. Earle, M. J.; Seddon, K. R. *Pure and Applied Chemistry* 2000, 72, 1391-1398). Finally the thermodynamic driving force for the reduction of the species can be controlled precisely minimizing side reactions and disproportionation common to plasma based reduction of actinide halide complexes. In this specification, the term "ionic liquid" essentially refers to a salt which melts at a relatively low temperature. For example, the electrochemical reactions in RTIL can be conducted at room temperature or moderately elevated temperatures in the range of 30-200° C. without significant degradation of the ionic solvent. Ionic liquids free of molecular solvents were first disclosed by Hurley and Wier in a series of U.S. Pat. Nos. (U.S. Pat. Nos. 2,446,331, 2,446,349, 2,446,350). Common features of ionic liquids include a near zero vapor pressure at room temperature, a high solvation capacity and a large liquid range (for instance, of the order of 300° C.). Known ionic liquids include aluminium(III) chloride in combination with an imidazolium halide, a pyridinium halide or a phosphonium halide. Examples include 1-ethyl-3-methylimidazolium chloride, N-butylpyridinium chloride and tetrabutylphosphonium chloride. An example of a known ionic liquid system is a mixture of 1-ethyl-3-methylimidazolium chloride and aluminium (III) chloride.

The RTIL system of the present technology may include an asymmetric organic cation and a large anion that can both be varied to influence the solution properties including solubility, viscosity, and the overall potential window for electrochemical experiments. (Earle, M. J.; Seddon, K. R. *Pure and Applied Chemistry* 2000, 72, 1391-1398. Buzzeo, M. C.; Evans, R. G.; Compton, R. G. *ChemPhysChem* 2004, 5). In this work, the anion selected was n-Bis(trifluoromethansulfonylimide) (TFSI), and the cation was trimethyl-n-butyl amine. The combination of this pair allows for a low melting point liquid with high ionic conductivity. In addition, the potential window for this solvent system is on the order of six volts encompassing negative potentials for the reduction of both lanthanides and actinides to metal. Solubility can be an issue when trying to introduce species into the RTIL. While solubility can be influenced using different combinations of cation/anion pairs, the combinatorial approach required to identify the RTIL species is not feasible due to the sheer magnitude of pairs that exist and the inherent cost. Therefore, forming complexes with anions common to the RTIL were specifically targeted to enhance solubility of the species in RTIL.

Previous work suggests that the electrochemical deposition of Uranium metal is possible under appropriate molten solvent conditions. For example, Uranium metal deposits were successfully obtained from U(III) and U(IV) complexes in molten salt systems. For comparison the uranium complexes $U(TFSI)_3$ and $U(TFSI)_4$ were prepared in our laboratory for the electrochemical studies using RTIL. However, we will focus on the $U(TFSI)_3$ system. All experiments were performed in an Argon evacuated glove box to minimize the formation of oxides after reduction of the uranium TFSI complexes in RTIL. The complexes directly dissolve in the RTIL after addition.

Uranium metal can be electrochemically deposited from room temperature ionic liquid (RTIL), tri-methyl-n-butyl ammonium n-bis(trifluoromethansulfonylimide), $[Me_3N^nBu][TFSI]$ providing an alternative non-aqueous system for the extraction and reclamation of actinides from reprocessed fuel materials. Furthermore, deposition of U metal is achieved using TFSI complexes of U(III) and U(IV) containing the anion common to the RTIL. The goal was to produce TFSI complexes of uranium to ensure solubility of the species in the ionic liquid. The methods outlined provide a first measure of U metal deposition using Uranium complexes with different oxidation states from RTIL solution at room temperature.

The US Argonne National Laboratory developed a new apparatus called Plannar electrode Electrorefiner (PEER). The apparatus is designed to deposit an anode including a metallic fuel in the middle and a plurality of cathodes therearound and operate an electrolytic reaction. After a certain time passes, the electrodeposits are attached on the cathode and a porous ceramic plate is moved in a vertical direction to scrap out the cathode electrodeposits. In general, when an electrorefining process is carried out, the density of a current applied to an electrode relates to an electrodeposition rate in a cathode and a sticking coefficient. As the current density is increased, a lot of uranium can be electrodeposited for a short time when it comes to the electrolytic rate. The sticking coefficient is defined as the amount of the electrodeposits stuck to a cathode surface to the amount of uranium metal transmitted to the cathode. Therefore, if the current density is increased using the electrode, the electrolytic rate is increased to decrease the sticking coefficient. The magnitude of the current density applied to the apparatus for an electrorefining or electrodeposition according to the present invention depends on the content of an allowable electrodeposit, preferably the current density of which the sticking coefficient is 0%. The current density of which the sticking coefficient is 0% may be defined experimentally. For example, a current density greater than of between the current used during step c) to cause electrodeposition is in the range of between 10 μamps and 500 μamps/$cm^2$ and preferably between 50 μamps and 150 or 200 μamps/$cm^2$ is a range that can be conveniently applied in one embodiment of the present invention using a single carbon rod as a cathode.

The electrochemical response for $U(TFSI)_3$ (solid line) is presented in FIG. 1 with the corresponding background (dashed line) for the RTIL. The cyclic voltammetric response for $U(TFSI)_3$ is for the $10^{th}$ cycle. There is a much higher current density due to the increased surface area associated with increased surface deposits of Uranium. Sequential cycle results in an increase in current density as the surface deposit increases increasing the overall surface area on the electrode (not shown). A voltammetric reduction wave is observed in the negative potential scan at ~−1.25 V consistent with the deposition of U(0) on the electrode surface. The reverse scan shows a voltammetric wave at ~0.75 which can be attributed to the combined oxidation of U(III) to U(IV) and the partial oxidation of the U deposits. However, there is a net increase in surface deposition of uranium after each voltammetric cycle. The electrochemical deposition was achieved using multiple techniques include cyclic voltammetry and constant potential methods. For the constant potential methods deposition was conducted at/or more negative than −2.0 V. Dark grey deposits were obtained on the electrode surface indicative of U metal deposition.

Scanning electron microscopy and energy dispersive spectroscopy (SEM-EDS) analysis was used to evaluate the deposit and provide information regarding the speciation. The electrode was protected from air during transportation by sealing the sample argon evacuated container immediately prior to placement in the SEM. The SEM image of a clean gold electrode (top) and the deposited electrode (bottom) are shown in FIG. 2. The Au surface is clearly visible in the SEM image for the deposited electrode. The surface deposits were examined at eleven sights using EDS, FIG. 3. The EDS spectrum has bands characteristic of the U deposits, with some residual S from the RTIL. The deposits are sufficiently thick that the contribution of Au to the EDS spectrum is not observed. In addition, the uranium deposits were observed with no detectable oxygen in the EDS response. The results confirm that the electrochemical deposition of U metal from $U(TFSI)_3$ complex is feasible from RTIL solutions.

Secondary analysis of the deposits was conducted following SEM-EDS analysis using powder x-ray diffraction (XRD) for deposits from $U(TFSI)_3$ in RTIL, FIG. 4. This sample was also protected from air in a similar manner as for the SEM analysis, including sealing the XRD sample container. The crystallographic phase of the uranium deposit was evaluated using powder XRD. Uranium can be found in three phases: alpha, beta, and gamma at temperatures below 1135° C. The alpha phase is the predominant form at room temperature. Although the penetration of the source is such that the Au electrode is the predominant species in the powder XRD, alpha uranium metal is observed. The XRD response confirms the EDS analysis that uranium metal is deposited on the Au electrode.

The studies outlined demonstrate that uranium metal deposition was achieved at room temperature from ionic liquid containing trimethyl-n-butyl amine cation with the TFSI anion. Furthermore, the nature of the deposit was analyzed using both SEM-EDS and powder XRD. The deposition of alpha uranium metal was confirmed on the Au electrode surface. The results suggest that actinide deposition from RTIL solutions my useful in replacing alternative methods for obtaining uranium metal including chemical vapor deposition with plasma reduction and deposition from molten salt systems.

Prophetic Example

The deposition of U has been achieved using three different species: $U(TFSI)_3$, $U(TFSI)_4$, and $UI_3(THF)_2$. Each sample was prepared using 4 ml of RTIL solution with ~10 mg of total U content. The complexes were dissolved directly into the ionic liquid with simple mixing. Similar methods were used for the dissolution and deposition of Sm metal using $Sm(TFSI)_3$ into the RTIL. The potential dependent deposition of U from RTIL solutions containing the complexes was conducted using a three electrode cell containing a cathode (Glassy Carbon disk or Au sheet) with a Pt counter electrode and a $Ag/Ag^+$ reference electrode filled with 0.1 M $AgNO_3$ in RTIL. Current versus time plots were obtained using an applied potential for each experiment of −2.2 V vs. NHE. The deposition was conducted over a 24 hour period without mixing. Under these conditions 6-8 $mg/cm^2$ of U metal was deposited at the gold cathode using normal diffusion with a measured current density on the order of 10 $\mu A/cm^2$. The gold cathode was in the form of a sheet (1 $cm^2$) that was transferred directly to do both the TEM and XRD analysis of the deposits. Similar deposition was achieved using glassy carbon disk electrodes as the cathode. Cyclic voltammetric techniques were also utilized to deposit U metal at the cathode as shown in FIG. 3.

The above prophetic example is based on actual experiments, however, the example has been broadened without determining the efficiency of deposition of U. However, these experiments can determine the efficiency of the processes using different U complex materials. The applications of this process are far reaching. It could simply be the reclamation of unused U from used fuel. It could also be the production of U targets for use in cross-section measurements. Finally, it could be used in the dissolution and reclamation of Tc99, a radiopharmaceutical that is produced during U fission processes.

Other variants, alternatives and substitutions can be provided by one skilled in the art within the framework of the generic invention described herein.

The sequential dissolution of 0.1 gram quantities of $U_3O_8$ (s) in IL containing 0.1 M HTFSI using ozone was conducted. The dissolution was examined at ambient temperature using an ozone stream of 1-2 wt % at rate of 450 cc/min in an air stream of 18-20% oxygen. Complete dissolution of the $U_3O_8$ solid occurred within twenty-four hours after each 0.1 g addition without adding any additional water or acid to the system. Increases in the absorbance for the soluble uranyl ion are observed for increasing concentrations of soluble $U_3O_8$. Previously the dissolution of $U_3O_8$ was not achieved in task specific ionic liquid, $[CH_3N^+COOH][TFSI]$ at temperatures below 473 K and only limited solubility (~0.5-0.75 wt %) was achieved at elevated temperatures. For comparison, the solubility achieved for the dissolution of $U_3O_8$ using ozone is 3% by weight in $[Me_3N''Bu][TFSI]$ containing 0.1 M HTFSI. The measured value does not represent the maximum solubility of $U_3O_8$ because each addition dissolved completely and saturation was not achieved in the IL. The electrochemical deposition of $UO_2$ (s) was also achieved from the 3% solution of soluble $U_3O_8$ on an electrode surface providing a mass density of 10 $mg/cm^2$. The example provided highlights the dissolution and recovery of uranium oxide from ionic liquid.

What is claimed:

1. A method for the electrochemical deposition of an actinide metal comprising:

dissolving an actinide oxide in a room temperature ionic liquid at room temperature in the presence of a stream comprising ozone to form an actinide rich liquid composition;

providing an electrode and a cathode within the actinide rich liquid composition;

at temperatures below 30° C., applying a potential such that current passes between the electrode and cathode to deposit actinide metal on the cathode.

2. The method of claim 1, wherein the ionic liquid comprises a tetra-alkyl group ammonium cation and an n-bis(perfluoroalkansulfonylimide) anion.

3. The method of claim 2, wherein each alkyl of the tetra-alkyl group ammonium cation is selected from methyl, ethyl, propyl, butyl and pentyl groups.

4. The method of claim 2, wherein the tetra-alkyl group ammonium cation is a tri-methyl-n-butyl ammonium.

5. The method of claim 2, wherein the n-bis(perfluoroalkansulfonylimide) anion is selected from the group consisting of an n-bis(trifluoromethansulfonylimide) anion and an n-bis(pentafluoro-ethansulfonylimide) anion.

6. The method of claim 1, wherein the actinide deposited comprises uranium.

7. The method of claim 1, wherein the actinide deposited comprises plutonium.

8. The method of claim 1, wherein at least some of the actinide metal is selected from the group consisting of uranium, plutonium, americium, and curium.

9. The method of claim 1, wherein the stream comprises between 1 wt % and 2 wt % ozone.

* * * * *